US005267703A

United States Patent [19]

Biagiotti

[11] Patent Number: 5,267,703

[45] Date of Patent: Dec. 7, 1993

[54] APPARATUS FOR CONTROLLING THE PRODUCTION OF PAPER ROLLS PRODUCED BY THE REWINDER IN ORDER TO ENSURE STEADINESS OF LENGTH OF THE WOUND PAPER AND/OR OF REACHED DIAMETER

[75] Inventor: Guglielmo Biagiotti, Vorno, Italy

[73] Assignee: Fabio Perini S.p.A., Lucca, Italy

[21] Appl. No.: 967,542

[22] Filed: Oct. 27, 1992

Related U.S. Application Data

[63] Continuation of Ser. No. 685,169, Apr. 15, 1991, abandoned, which is a continuation of Ser. No. 517,548, Apr. 26, 1990, abandoned, which is a continuation of Ser. No. 303,302, Jan. 30, 1989, abandoned.

[30] Foreign Application Priority Data

Jan. 29, 1988 [IT] Italy ..... 9318 A/88

[51] Int. Cl.[5] ..... B65H 17/08

[52] U.S. Cl. ..... 242/66; 242/75.51

[58] Field of Search ..... 242/56 R, 66, 67.1 R, 242/75.51, 57

[56] References Cited

U.S. PATENT DOCUMENTS

| | | | |
|---|---|---|---|
| 3,279,718 | 10/1966 | Arterton et al. | 242/67.1 R |
| 3,977,619 | 8/1976 | Nagata et al. | 242/67.1 R |
| 4,150,797 | 4/1979 | Kataoka | 242/67.1 R |
| 4,351,494 | 9/1982 | Schippers et al. | 242/35.5 A |
| 4,480,798 | 11/1984 | Robinson et al. | 242/67.1 R |
| 4,496,112 | 1/1985 | Olsson et al. | 242/66 |
| 4,535,949 | 8/1985 | Olsson | 242/66 |
| 4,811,915 | 3/1989 | Smith | 242/66 |
| 4,817,883 | 4/1989 | Hoffman et al. | 242/66 |
| 4,883,233 | 11/1989 | Saukkonen et al. | 242/66 |

FOREIGN PATENT DOCUMENTS

| | | | |
|---|---|---|---|
| 0082756 | 7/1981 | Japan | 242/78.1 |

*Primary Examiner*—Stuart S. Levy
*Assistant Examiner*—Joseph A. Rhoa
*Attorney, Agent, or Firm*—Francis J. Bouda

[57] ABSTRACT

An apparatus for winding small rolls of paper from large rolls includes a counter to measure the length of the web being wound, a presser to sense and control the outer diameter of the small rolls, an encoder to detect and control the diameter of the small roll as it approaches the pre-determined desired diameter thereof, and an electronic logic control connected to the counter, the presser and the encoder whereby to ensure that the weight of paper and the outer diameter of the small rolls will always be within the predetermined limits. The apparatus may also include a device to record the weight of the small roll and sensors to automatically adjust the length of the web and also the roll diameter as the small roll is being formed. The sensors may also include fine and coarse tuners to adjust more precisely the movement of the web onto the small roll within relatively narrow tolerances.

10 Claims, 3 Drawing Sheets

APPARATUS FOR CONTROLLING THE PRODUCTION OF PAPER ROLLS PRODUCED BY THE REWINDER IN ORDER TO ENSURE STEADINESS OF LENGTH OF THE WOUND PAPER AND/OR OF REACHED DIAMETER

This is a continuation of co-pending application Ser. No. 07/685,169 filed on Apr. 15, 1991, now abandoned, which is a continuation of application Ser. No. 517,548 filed Apr. 26, 1990, now abandoned, which is a continuation of application Ser. No. 303,302 filed Jan. 30, 1989, now abandoned.

BACKGROUND OF THE INVENTION

In the preparation of logs or rolls of paper of relatively small diameter from large diameter rolls produced on a paper-making machine, the equipment and apparatus have been well developed to produce such logs or rolls automatically and at high speed.

Relevant patents relating to the background of this type of paper-converting machinery and process are the U.S. Pat. Nos. 3,869,095, 4,327,877 and 4,422,588.

In the preparation of these logs or rolls, the web of paper fed to the machine quite often varies in basis weight, caliper, surface characteristics and the like, and it is also important that the manufacturer provide the precise number of sheets or usable units in each of the finished rolls.

All of this has to be accomplished while keeping the outside diameter of the roll within pre-determined limits, which are generally dictated by the wrapping and packaging equipment, as well as by the size of the holder or dispenser on which the finished roll is used by the consumer.

The core on which the paper is wound may also vary in diameter, and this creates a further problem for the manufacturer in keeping the outside diameter of the finished roll within pre-determined limits.

Under the circumstances, it is important for economic and commercial reasons that the length of the paper wound into the roll, the number of sheets or usable units provided in the roll, and the outside diameter of the roll, be controlled as accurately as possible. The apparatus of the present invention provides such equipment.

SUMMARY OF THE INVENTION

The apparatus comprises means for detecting the desired diameter, means for detecting the weight of a finished roll and/or of the length of paper wound at any moment, means for pre-setting the final diameter to be reached, as well as means for comparing the pre-set data with the detected ones, and correction means to keep length and diameter or weight and diameter steady.

DETAILED DESCRIPTION

The invention relates to machines for paper manufacture and, in particular, to the rewinders, i.e., machines which are fed with one or more large rolls or with a roll of two-ply paper, for the production of "logs" or rolls of paper having relatively smaller diameter. These "logs" are subsequently cut perpendicularly to their axes to provide small rolls of paper for use as toilet paper, kitchen towels, or for similar uses. In these machines, it is suitable and sometimes indispensable to provide an exact diameter of the roll so that the small rolls meet requirements of successive operations, such as cutting and packaging, as well as practical requirements, such as fitting into a toilet-roll dispenser.

It is also suitable (or even necesary) that the exact diameter be obtained with a precise and pre-determined length of paper, or with a precise and pre-determined number of sheets (when the paper is perforated to be detached in sheets of equal length), again for commercial requirements and so as not to exceed desired paper length according to economical requirements.

A particular requirement is that of keeping the length (that is, the number of sheets of the paper) or the weight of the small roll, and the diameter of the small rolls uniform, even though the characteristics (such as basis weight or caliper or surface finish) may not be constant.

The apparatus in question ensures control and correction of the production in order to achieve uniformity of the above-mentioned cahracteristics.

Therefore, it is an object to provide an apparatus for controlling the production of rolls or "logs" of paper produced by a rewinder fed with large rolls or two-ply paper rolls, especially for ensuring an exact overall diameter and paper length and/or paper weight within pre-set limits. It includes means for detecting the desired diameter, means for detecting the weight of a finished roll and/or the length of paper wound into the roll, means for pre-setting the final diameter to be reached, means for comparing the pre-set data with the detected ones, and correction means.

Advantageously, the correction means may comprise a regulator for adjusting the pressure, i.e., the thrust exerted by a small presser acting on the surface of the roll being formed.

The diameter-sensing means may be associated with the small presser, and it is activated when the desired diameter is reached.

The apparatus may be combined with an electronic logic able to operate a correction by means of the small presser acting on the roll being formed and activated by the thrust exerted by said roll on the presser.

The apparatus may comprise at least two sensors and a cam member, or an encoder, for evaluating limit positions, and thresholds for controlling fine and coarse adjustments according to the sensed diameter of the stick, i.e., according to the position of the presser assembly. There can be provided two fixed sensors, which have adjustable position and interspace, and a screen member located on an arm for the angular displacement of the presser, in order to obtain the various adjustments through four practicable and subsequent pulses. Alternatively, the diameter sensor may be arranged as an encoder that measures the angular displacement of the presser arm.

According to another embodiment, a weighing means may be provided, such as a load cell, able to evaluate the weight of the log or roll as data to be used for corrections.

Therefore, the apparatus provides for carrying out the simultaneous control of the diameter and length of the paper or of the weight of the log up to the pre-determined limit. Moreover, the apparatus provides for keeping said diameter exact when the characteristics of paper are changing, either by imposing a change of length of the paper supplied for each roll, or by keeping the length, and the diameter steady trough a variation of the thrust operated by the small presser.

In one embodiment, the presser thrust is reduced, thus increasing the roll diameter with the same length of wound paper. Vice-versa, paper may be added to the roll, in order to reach the desired length, by causing a greater thrusting action of the presser on the roll, to reach the pre-set diameter with a greater quantity of rolled-up paper.

In a further embodiment, the apparatus allows the paper weight to be kept steady through a variation of the length, and by maintaining the diameter steady through a variation of the presser thrust on the roll being formed.

All the operations can be carried out with the machine in operation, without interrupting the production process, and providing for successive corrections up to the restoration of the pre-set and desired limits.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
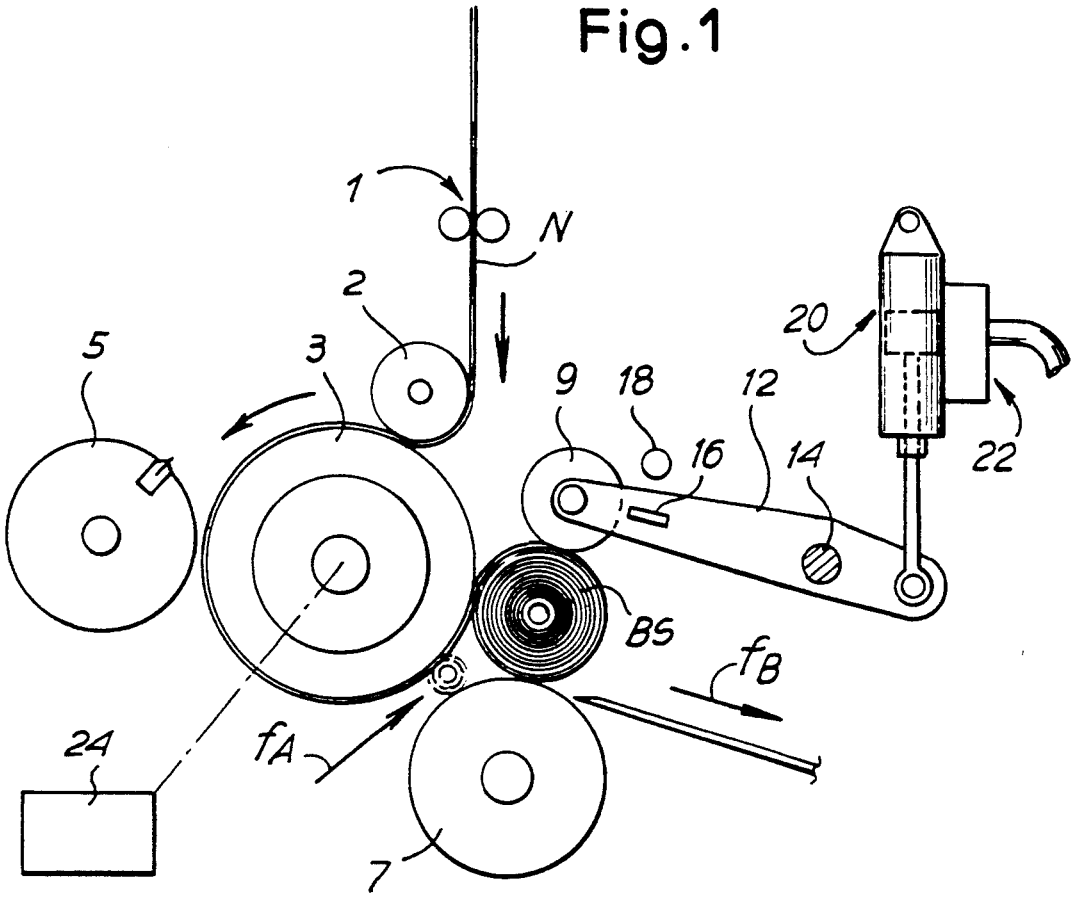
FIG. 1 shows a schematic representation of a rewinder, limited to the main members for the winding of the paper web into a roll.

Referring to the attached drawings, and particularly FIGS. and 3, the continuously fed paper web N is transversally perforated at equal distances (to provide sheets) by a device 1 and is turned by a cylinder 2 in order to be fed to the main cylinder 3. Cylinder 3 determines the total length of web to be wound and includes a cutting device, including a cylinder 5, which carries out the cutting of said web N.

A cylinder 7 cooperates with cylinder 3 and defines an interspace with it, wherein a tubular core, preferably made of cardboard, is inserted—in a known manner—in the direction of arrow fA. The paper web is wound on the core to form the roll or log BS, which is then suitably moved away in the direction of arrow fB. Such cutting and winding arrangements are well-known, as shown in U.S. Pat. No. 4,327,877. They may include also a so-called presser, i.e., a further pressing roller indicated by 9, which is movably mounted, for example, on a pair of arms 12 pivoted at 14. Presser 9 is able to produce a suitable pressure, that is, a thrust on the roll BS being formed and thus to completely define the diameter of the roll.

Presser 9 is capable of varying the pressure exerted on the roll BS being formed and thereby compact the paper in the roll to a more or less degree. The presser 9 assembly, with its supporting arms 12, allows also to sense the diameter of the roll being formed and, therefore, the presser itself may cooperate with a diameter evaluating sensor. For example, the regulation of the pressure exerted by the presser on the roll may be obtained by an adjustable weight slidable along arm 12, by a screw-control or other device (not shown).

As shown in FIG. 1, a sensor is provided for evaluating said diameter, which sensor comprises a screen 16 located on the arms 12, and a sight 18 of optical type such as an "electric eye", for example, at a fixed position. A more simple arrangement includes a suitably positioned microswitch which establishes the diameter that the roll BS must reach to meet the above-mentioned requirements. Two optical sensors may be provided that can regulate the coarse and fine corrections of the presser thrust on the paper.

On the assembly of arms 12 of presser 9, means is provided for adjusting the pressure to be exerted by presser 9 on the roll BS being formed. The regulator may consist of a cylinder-piston system 20 supplied by pressure adjustable through a control system, generally indicated by 22, which is dependent on control means electronically operated according to a suitable program. The regulator may operate by increase of the pressure inside the system 20 and thus reduce the presser thrust on the roll, and vice versa.

Figure 2:
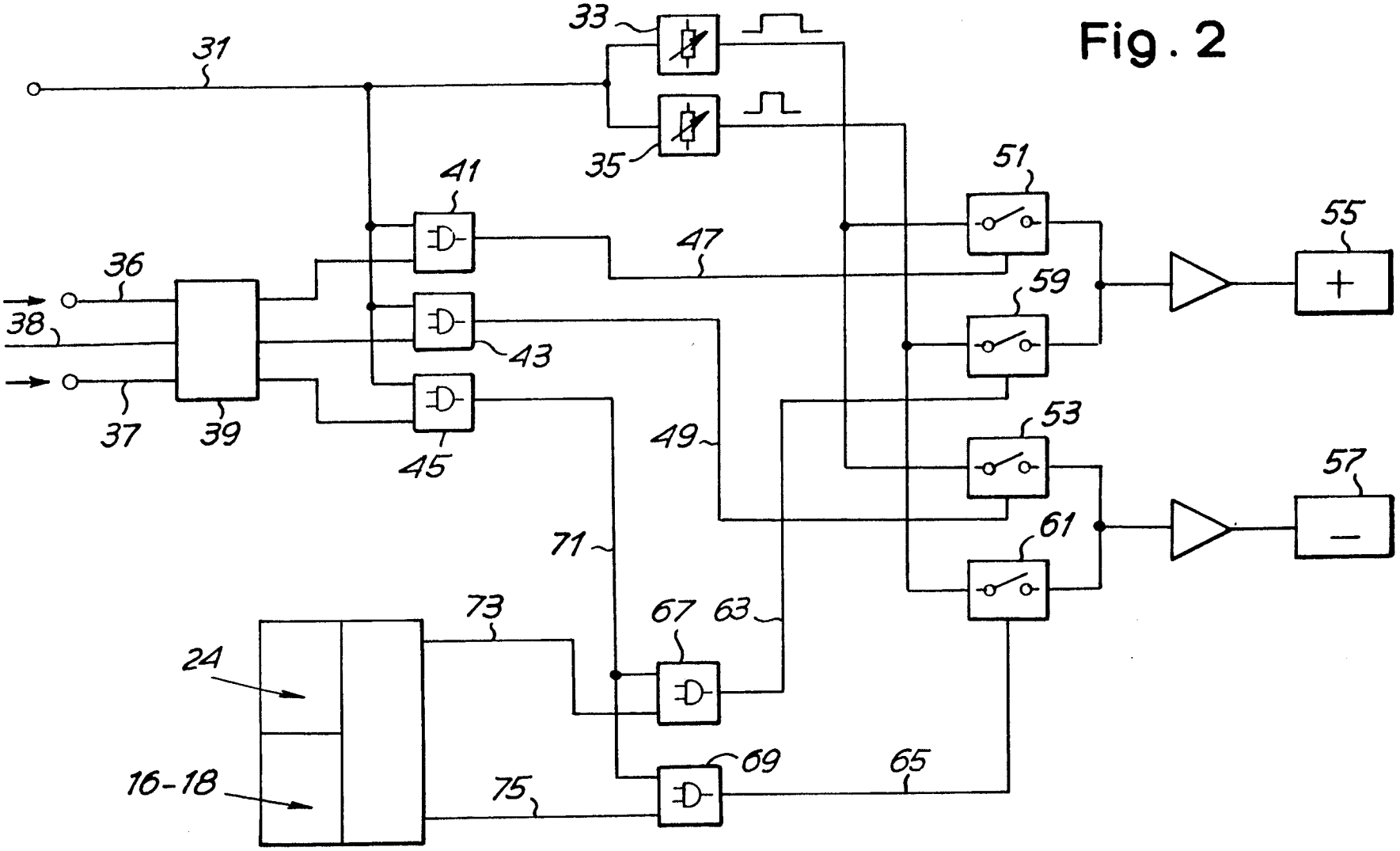
FIG. 2 shows a block diagram of the electronic parts relevant to the correction system.

FIG. 2 shows an electronic block diagram including an input 31 for the data concerning the desired diameter, which data are obtained by a sensor like that indicated by 16,18 in FIG. 1. Numerals 33 and 35 in FIG. 2 indicate two timers which are set for a longer and shorter time, respectively, to obtain coarse and fine corrections, respectively. Numerals 36 and 37 indicate the date input for setting the lengths (i.e., the meters) of paper representing the limits of the allowable range of paper, while numeral 38 indicates the input of the actual value of the length of the fed paper, such input being supplied through a counter 24 associated with cylinder 3. Numeral 39 indicates an electronic logic which can receive a card (which can be easily changed) containing the program. Numerals 41, 43, and 45 indicate three gates associated with the three outputs of electronic logic 39 and which receive also the data relevant to the reached diameter from input 31. Gates 41 and 43 are intended for the coarse correction and gate 45 for the fine correction.

From gates 41 and 43 data are fed through lines 47 and 49 to two switches 51 and 53, respectively, for increasing or decreasing coarse correction represented by blocks 55 and 57 respectively. Switches 51 and 53 receive the correction time from timer 33 which is set for a longer duration. The two corrections 55 and 57 may also be activated by switches 59 and 61, provided for the fine adjustment, which are connected to timer 35, set for the shorter duration, and by gates 67 and 69. The correcting signals arrive at switches 59 and 61 via two lines 63 and 65, respectively, coming from two gates 67 and 69 fed with data obtained via line 71 from the gate 45 of the electronic logic. Data for the delivery of the type of fine correction to be made are obtained from lines 73 and 75 which are connected to the counter 24 for detecting the length of passed paper, said counter being connected, for example, to cylinder 3 and to the diameter sensor such as that indicated by 16 and 18.

The operation of the apparatus is as follows.

As the optical sensor (or microswitch) 16, 18—either single or dual—is activated because the roll diameter has reached the desired preset value, and the counter 24, which provides the information relative to the length of wound paper has not arrived at any of the two selections preset by 36 and 37 in the electronic logic, it is necessary to increase the length of paper and thus the pressure of presser 9 must be increased so that greater compaction of the rolls of paper will allow an accumulation of a larger amount of paper while maintaining the roll diameter at the desired value.

If the microswitch 16, 18 is actuated and the counter 24 has already reached the upper selection limit for the allowable paper length, this means that there is sufficient paper in the roll, and as a consequence the pressure of presser 9 must be lowered so that the desired diameter is reached with a smaller amount of paper.

The two above-mentioned corrections are achieved through timer 33 and the enabling controls on switches 51 and 53 coming from gates 41 and 43 respectively.

Figure 3:
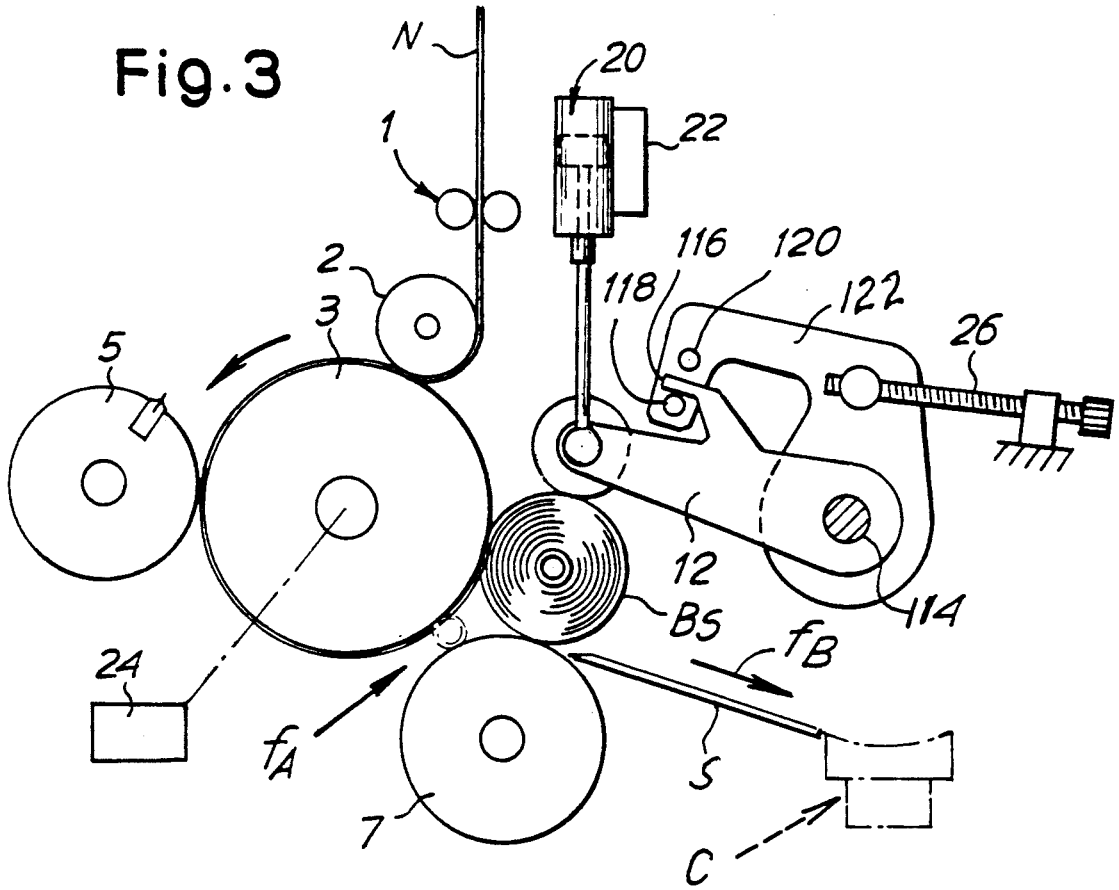
FIG. 3 shows another embodiment similar to FIG. 1.
Figure 4:
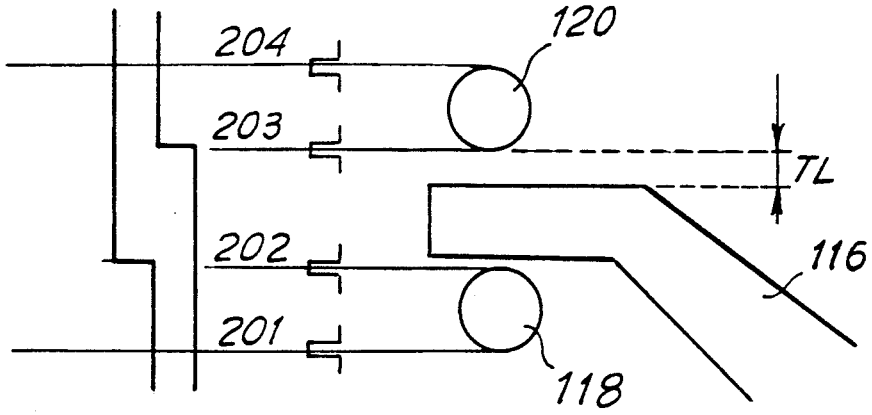
FIG. 4 shows an explanatory switching diagram.

FIGS. 3 and 4 show a modified embodiment, in which two proximity or optical sensors 118 and 120 can cooperate with a screening body 116 carried by arm 12. Sensors 118 and 120 may be carried by a support 122 pivotable at 114. Likewise arm 12 is pivotable at 114. Support 122 is adjustable, for example, by a screw 26 to set the position of the two sensors 118 and 120 and thus the desired diameter for roll BS. The distance between the two sensors 118 and 120 can also be adjusted for establishing the tolerance of the diameter of roll BS.

In this embodiment, the regulation system is driven by a series of pulses. With reference to the diagram of FIG. 4, lines 201, 202, 203 and 204 may be considered as the thresholds delimited by pulses obtained from the pair of sensors 118 and 120 influenced by screen 116, wherein:

201 corresponds to the screening (actuating) pulse of the first sensor;

202 corresponds to the releasing (abandoning) pulse of the first sensor;

203 corresponds to the screening (actuating) pulse of the second sensor; and

203 corresponds to the releasing (abandoning) pulse of the second sensor.

The regulation may be carried out by comparing the output of counter 24 driven by the main cylinder 3 (proportional to the length of wound paper) with pulses 201, 202, 203 and 204 through the following logical consequences:

(1) If the preset counting goes off and pulse 201 has not yet arrived, it is necessary to provide a coarse regulation to lower the presser thrust and slacken the winding in order quickly to increase the diameter of roll BS;

(2) If the preset counting goes off and pulse 201 has already arrived, it is necessary to provide a fine regulation to lower the presser thrust;

(3) If the preset counting goes off when pulse 201 has already been delivered and pulse 202 has not, it is necessary to provide a fine regulation in order to increase the presser thrust;

(4) The moment pulse 202 goes off and up to the moment the pulse 203 goes off, the diameter is within the tolerance range;

(5) If the preset counting goes off and pulse 203 has already arrived, it is necessary to provide a fine regulation in order to increase the presser thrust;

(6) In the interval between pulses 203 and 204, the fine regulation is maintained;

(7) If the preset counting goes off and pulse 204 has already arrived, it is necessary to provide a coarse regulation in order to increase the presser thrust and reduce the diameter.

All this is accomplished by utilizing the two proximity sensors 118 and 120 whose distance of application determines the tolerance field TL accepted for the roll diameter, in relation to the thickness of the screening body 116 carried by the presser 9, 12.

Another solution can be that of mounting a pulse generator on the fulcrum 14 of arm 12 of presser 9 and comparing the pulses thereof with those emitted by the counter 24 on cylinder 3 with the same criteria as those of the preceding solution.

What has been described above relates to a kind of operation in which a certain length of paper is set beforehand, and diameter adjustments are imposed through variations of the thrust operated by presser 9 on the roll being formed in order to assure that the final diameter of the rolls is at the desired value.

As soon as the screening body 116 obscures the first sensor 118, a pulse takes place and the programmer compares the length of paper passed through—evaluated by pulses produced by the counter 24 on cylinder 3—with the preset length (which takes into account a constant which is necessary to carry out the whole exchange cycle) and, if the two values are substantially equal, the change of rolls (an operation which always takes place in any case) is actually carried out without making a change in the presser thrust. If, instead, the two values are different (being either greater or smaller) the system will initiate a change by decreasing or increasing the thrust of the presser in order to correct the amount of paper in the roll. The greater the difference between the two countings (paper length and diameter of roll BS), the greater will be this correction.

Alternatively, the diameter and weight of the roll may be preset and the corrections performed by imposing variations in the length of paper. In this case, the diameter of the roll is ensured but not the length of the wound paper, which length may vary by an amount of even one revolution of cylinder 3.

Weighing systems may be included, such as load cells like those shown in dotted lines at C in FIG. 3 for weighing the roll which has left the position BS (where it was formed) and has moved along chute S in the direction of arrow fB. By the weight date it is possible to affect the corrections of the presser thrust and/or of the length of the paper which has been fed to each roll.

It is furthermore to be understood that the present invention may be embodied in other specific forms without departing from the spirit or special attributes, and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to be protected by Letters Patent are the following:

1. In a winder which sequentially produces a plurality of small rolls of paper from larger rolls of single or multi-ply webs, a small roll of web material of finite length and diameter in said winder, and a control system which ensures the uniformity of the overall diameter of the small rolls from roll-to-roll while maintaining within pre-established tolerances and pre-established limits the length of the web of the paper in each small roll, said control system including:

means for pre-setting desired diameter and length data into the control system, and means for detecting the outer periphery of the small roll once it has been formed, and means for detecting the length of the web in the small roll as it is being wound, and means for comparing the pre-set diameter and length data with the detected diameter and length data, and means for automatically correcting and adjusting the system only at the end of the winding of each small roll so that subsequent diameters of small rolls will conform to the pre-set diameter data, based on data coming from said means for comparing the pre-set diameter and length data with the detected diameter and length data, said periphery detecting means including a small roller for contacting the outer periphery of the small roll and moving with the small roll while it increases in diameter as it is being formed.

2. The system of claim 1 including an electronic logic operatively connected to the small roller and the periphery detecting means whereby to maintain constant pressure of the roller on the small roll while the small roll is being formed.

3. The system of claim 2 including an encoder which detects the outer periphery once the roll has been formed and allows the system to control the diameter of subsequent small rolls.

4. The system of claim 2 including an encoder which, via the electronic logic, re-sets the diameter control data at the end of the winding of each small roll so that the diameter of subsequent small rolls will be within the pre-set tolerance limits.

5. The system of claim 1 wherein the correcting and adjusting means are activated and realized by changing the pressure of the small roller on the same roll.

6. In a winder which sequentially produces a plurality of small rolls of paper from larger rolls of single or multi-ply webs, a small roll of web material of finite length and diameter in said winder, and a control system which ensures the uniformity of the overall diameter of the small roll from roll-to-roll while maintaining within pre-established tolerances and pre-established limits the weight of the web of the paper in each small roll, said control system including:

means for pre-setting desired diameter, weight, and length data into the control system, and means for detecting the outer periphery of the small roll once it has been formed, and means for detecting the weight of the web in the small roll once it has been wound, and means for comparing the pre-set diameter and weight data with the detected diameter and weight data, and means for correcting and adjusting the system only at the end of the winding of each small roll so that subsequent diameters and weight of small rolls will conform to the pre-set diameter and weight data, based on data coming from said means for comparing the pre-set diameter and weight data with the detected diameter and weight data said periphery detecting means including a small roller for contacting the outer periphery of the small roll and moving with the small roll while it increases in diameter as it is being formed.

7. The system of the 6 including an electronic logic operatively connected to the small roller and the periphery detecting means whereby to maintain constant pressure of the roller on the small roll while the small roll is being formed.

8. The system of claim 7 including an encoder which detects the outer periphery once the roll has been formed and allows the system to control the diameter of subsequent small rolls.

9. The system of claim 7 including an encoder which, via the electronic logic, re-sets the diameter control data and a scale which, via the electronic logic, re-sets the weight control data at the end of the winding of each small roll so that the diameter of subsequent small rolls will be within the pre-set tolerance limits.

10. The system of claim 6 wherein the correcting and adjusting means are done by changing the pressure of the small roller by adding or reducing the length of paper in the small roll.

* * * * *